US006076285A

United States Patent [19]

Caeran et al.

[11] Patent Number: 6,076,285

[45] Date of Patent: Jun. 20, 2000

[54] SPORTS SHOE

[75] Inventors: Francesco Caeran, Montebelluna; Renzo Balbinot, Pieve di Soligo; Valerio Tonel, Biadene, all of Italy

[73] Assignee: Benetton Sportsystem S.p.A., Trevignano, Italy

[21] Appl. No.: 09/039,332

[22] Filed: Mar. 16, 1998

[30] Foreign Application Priority Data

Jul. 31, 1997 [IT] Italy ..... TV97A0106

[51] Int. Cl.[7] ..... A43B 5/04

[52] U.S. Cl. ..... 36/115; 36/118.2; 36/50.5

[58] Field of Search ..... 36/115, 117.3, 36/97, 117.1, 118.2, 118.3, 50.5

[56] References Cited

U.S. PATENT DOCUMENTS 5,875,566 3/1999 Bourdeau et al. ..... 36/12

FOREIGN PATENT DOCUMENTS 195 27 320 1/1997 Germany .
94 211 49 9/1994 WIPO .
96 03 186 2/1996 WIPO .
97 32 496 9/1997 WIPO .

*Primary Examiner*—M. D. Patterson
*Attorney, Agent, or Firm*—Guido Modiano; Albert Josif; Daniel O'Byrne

[57] ABSTRACT

A sports shoe including a rigid supporting element which surrounds the sole and the sides of the foot and at least partially the rear part and the sides of the leg. A soft upper is associated with the rigid supporting element.

16 Claims, 7 Drawing Sheets

SPORTS SHOE

BACKGROUND OF THE INVENTION

The present invention relates to a sports shoe.

Currently, in the manufacture of sports shoes, such as for example roller skates, ice skates, ski boots or snowboard boots and trekking boots, the technical problem is strongly felt of simultaneously achieving two contrasting properties: a high structural rigidity for optimum force transmission and a high comfort for the foot during the sport practice.

French patent No. 1,395,865 discloses an improvement to sports shoes, particularly ski boots and skating boots, wherein a stiffening element is inserted inside a shoe and is substantially constituted by a rod having an L-shaped cross-section and arranged at the rear end of the shoe. The lower end of the stiffening element is inserted in the heel of the shoe, while the upper end is substantially C-shaped so as to surround the calf proximate to the upper end of the shoe.

This shoe does not solve the above-cited problems, because the rod does not ensure continuous and gradual support of the entire foot being active only during backward movements of the ankle. Moreover, the rod does not offer optimum lateral support, because it is subjected to torsion under said load.

U.S. Pat. No. 3,747,235 discloses a ski boot having a substantially L-shaped lever element which is rigidly connected, in a downward region, to the sole and extends upward up to the calf region.

This shoe offers a rear support to the leg of the user but does not also offer an equal support for the entire foot. Moreover, as in the previous shoe, optimum lateral support is not provided, because the lever element is subjected to torsion in case of lateral forces applied hereto.

These drawbacks are also observed in the other conventional shoes, with the further drawback due to the presence of means interposed between two mutually articulated components in order to limit mutual forward or backward flexing.

AT-337,047 discloses a ski boot having a substantially L-shaped internal stiffening element which is embedded directly in the structure that composes, in the illustrated case, a boot.

Also this shoe entails the above drawbacks, although the stiffening element has a longer wing which also affects the plantar arch region of the foot.

French patent No. 74 01671 discloses a ski boot constituted by a monolithic shell comprising an upper which is rigidly coupled to a sole and a rear quarter which has, in its upper part, two supports which surround the leg, the quarter being articulated to the shell by means of a stud.

However, a rigid structure is obtained which is suitable only for some sports activities and thus does not solve the technical problem mentioned initially.

Italian patent No. 1,051,302 discloses a boot composed of two bodies which are generally L-shaped in a lateral view and mutually overlap along lateral joining lines. The bodies are kept in this active position by fixing means.

The two bodies have stiffening ridges in preset regions and underlying walls which connect the ridges. Therefore, the two bodies must have at least two edges for joining and closing the two parts, in order to ensure securing of the foot and tightness against water infiltrations.

Accordingly, the regions proximate to the joint must be rigid and nondeformable in order to avoid compromising their tightness. This fact, however, entails a considerable limitation in the obtainable forward flexing of the leg, due to their advanced position.

Said regions further prevent, if they are rigid and nondeformable, any lateral flexing of the ankle if this is required by the particular type of sport being practiced.

The stiffening ridges also cover the entire outer surface and extend to the front regions, where they can limit the forward flexing of the leg, at the same time forming pressure points on the foot and on the leg and limiting the comfort of the boot during use.

Italian patent application No. 41654 A/82 relates to a method for manufacturing sports shoes which are substantially constituted by a shoe which does not have a sole and is inserted at a rigid shell that affects the sole of the foot, the sides of the foot, and part of the toe region and wraps to the rear around the heel alone.

The resulting shoe still does not solve the described technical problems, because it does not allow adequate stiffening and foot support, for example for skiing or skating. Moreover, due to the presence of the shell that surrounds the tip of the foot, problems may arise in terms of the flexing of said foot.

In any case, this shoe allows neither optimum transmissions of lateral forces nor optimum lateral support. Additionally, if the shell affects part of the user's leg, it requires the preliminary provision of openings and/or slits in several points to allow an easy foot insertion, once again negatively affecting both the lateral tightness and the flexibility of the shoe.

EP-0 484 845 discloses a ski boot composed of a shell and a cuff which are rigid and associated with flaps, mostly made of a soft material such as leather, fabric or other.

In the lateral regions of the cuff there are provided two stiffening elements suitable to transmit the forces from the leg to the boot.

Both stiffening elements are rotatably coupled to the shell, approximately at the malleolar region, by means of suitable studs.

Also this shoe entails drawbacks due to the constructive complexity of the shell and of the cuff, which are made of different materials. Subsequent assembly by means of studs is a further constructive complication which increases the final cost of the product.

EP-0 582 551 discloses a ski boot made of plastics, in which a shell is provided to which a rear quarter is articulated. At the quarter and shell there is provided a stiffening element which is connected approximately at the heel region and is composed of a first lower body connected at one end to a second body which surrounds the upper/rear part of the boot.

Also this solution entails the drawbacks of the cited prior art and therefore does not solve the mentioned technical problem.

SUMMARY OF THE INVENTION

The aim of the present invention is to solve the mentioned technical problems, eliminating the drawbacks of the cited prior art, by providing a shoe for sports practice which allows to simultaneously achieve the characteristic of optimum transmission of the efforts of the foot and optimum comfort for said foot.

An important object of the present invention is to provide a sports shoe which can be used in various sports, such as skating, skiing, trekking, climbing, while preserving the above-mentioned properties.

A further important object of the present invention is to provide a sports shoe which surrounds the foot in an optimum manner and gradually.

A further important object of the present invention is to provide a sports shoe which is simple from the constructive point of view.

A further object of the present invention is to provide a sports shoe which allows to rationalize the number of its components and therefore contain and simplify the number of the corresponding molds and fixtures required to obtain said shoe.

A further object of the present invention is to provide a sports shoe which is reliable and safe in use and allows to reduce production costs.

This aim, these objects and others which will become apparent hereinafter are achieved by a sports shoe, characterized in that it comprises a rigid supporting element and a soft upper, said rigid supporting element surrounding a sole region, side regions and a rear region of said shoe.

Advantageously, the shoe comprises one or more closure means for the flaps of the upper which are associated, at their ends, with said at least one rigid supporting element and/or with said upper.

BRIEF DESCRIPTION OF THE DRAWINGS

Further characteristics and advantages of the sports shoe according to the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
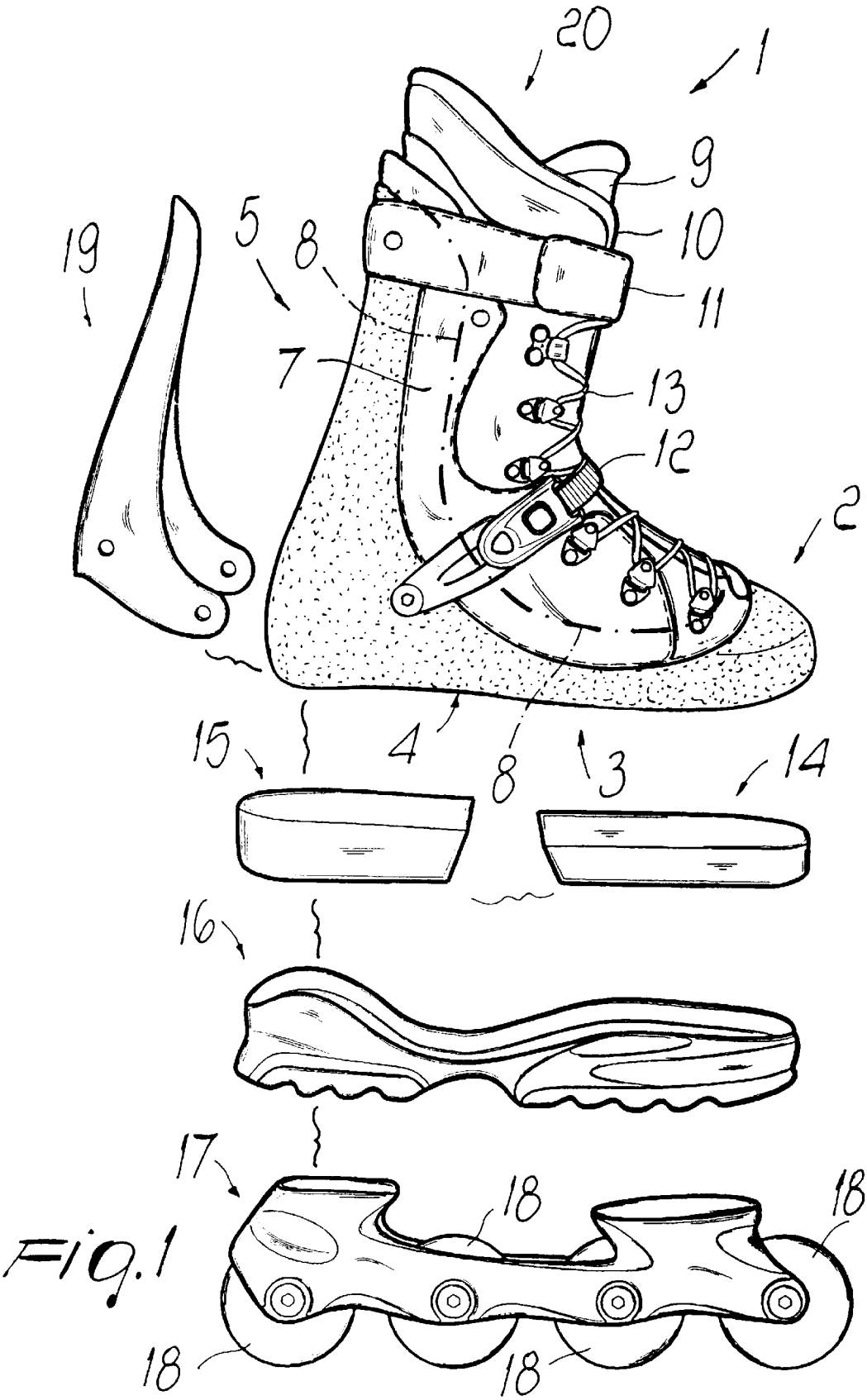
FIG. 1 is an exploded view of the components of a sports shoe.

With reference to the above figures, the reference numeral 1 designates a sports shoe which can be used for roller skating, ice skating, skiing, snowboarding, trekking or climbing or in any case for a sports activity which requires optimum transmission of forces from the foot to said shoe.

As shown in FIG. 1, the sports shoe is constituted by a rigid supporting element, designated by the reference numeral 2, which is preferably formed monolithically and, as viewed laterally, has a substantially L-shaped configuration.

Said rigid supporting element 2 has a box-like structure and affects, so as to surround them, the region 3 of the sole of the foot, the regions 4 of the sides of the foot and of the metatarsus, and partially the rear region 5 and the lateral regions 6 of the user's leg.

The sports shoe is also constituted by a soft upper 7 which is associated with said rigid supporting element 2 in a per se known manner, such as gluing, sewing, overmolding or others.

Advantageously, as shown in FIG. 1, the upper 7 partially externally surrounds the rigid supporting element 2, so as to include part of the region that is adjacent to the edge 8 of the rigid supporting element 2.

The upper 7 optionally has an inner lining and advantageously a central tongue 9 to facilitate foot insertion; said tongue 9 forms flaps 10 for the upper 8 which can be fastened by suitable closure means, such as for example straps 11, levers 12 or laces 13.

Conveniently, said closure means, particularly as regards preferably the straps and the levers, are associated at the rigid supporting element 2 at their ends.

The rigid supporting element of course has dimensions which comply with the specific requirements of the sport to be practiced. Thus, for example, FIG. 1 illustrates a sports shoe provided with a rigid supporting element 2 below which it is possible to associate a sole constituted for example by a toe unit 14 and a heel unit 15, both being standardized for alpine skiing, or a snowboard or trekking sole 16 or a frame 17 between which a plurality of wheels 18 are pivoted.

Additional rigid supporting elements, such as for example a spoiler 19 suitable to increase the rigidity of a specific part, such as for example the rear region 5 of the leg, can be rigidly coupled to the rigid supporting element 2.

Moreover, as regards the soft upper 7, it can comprise an inner padding 20 which is stably associated with the rigid supporting element 2 or with the upper or is detachably associable with the rigid supporting element 2 and/or with the upper 7, so that it can be extracted, thus constituting a conventional padded innerboot, for example for a ski boot or a skate.

The rigid supporting element 2 can of course have shapes, dimensions and thicknesses which are linked to the specific requirements and therefore to the specific sports activity performed with the shoe according to the present invention.

The method for interconnecting the toe unit, the heel unit, the sole and the frame at the region 3 of the rigid supporting element 2 may also be the one deemed most appropriate according to the specific sports activity being performed and therefore may be provided by stable connection means, such as gluing, sewing, overmolding, or by removable connection means, such as screws, interlock couplings or others.

It has thus been observed that the invention has achieved the intended aim and objects, a sports shoe having been provided which allows to simultaneously achieve optimum transmission of forces from the foot and optimum comfort for said foot, so as to be used in the most disparate sports.

Said sports shoe therefore surrounds the foot in an optimum and gradual manner, can be provided easily from the constructive point of view and is constituted by a limited number of components, so as to allow to provide a limited number of molds and fixtures in order to obtain the shoe, which can be constituted by basic elements of a standard type, such as the rigid supporting element 2, and by specific soft uppers 7 to obtain the different applications of the shoe according to the characteristics required by the various sports.

A sports shoe is also accordingly achieved which has low manufacturing costs.

The sports shoe according to the invention is of course susceptible of numerous modifications and variations, all of which are within the scope of the same inventive concept.

FIGS. 2–9 illustrate further embodiments of the invention, wherein like reference numerals denote similar features to those of FIG. 1.

Figure 2:
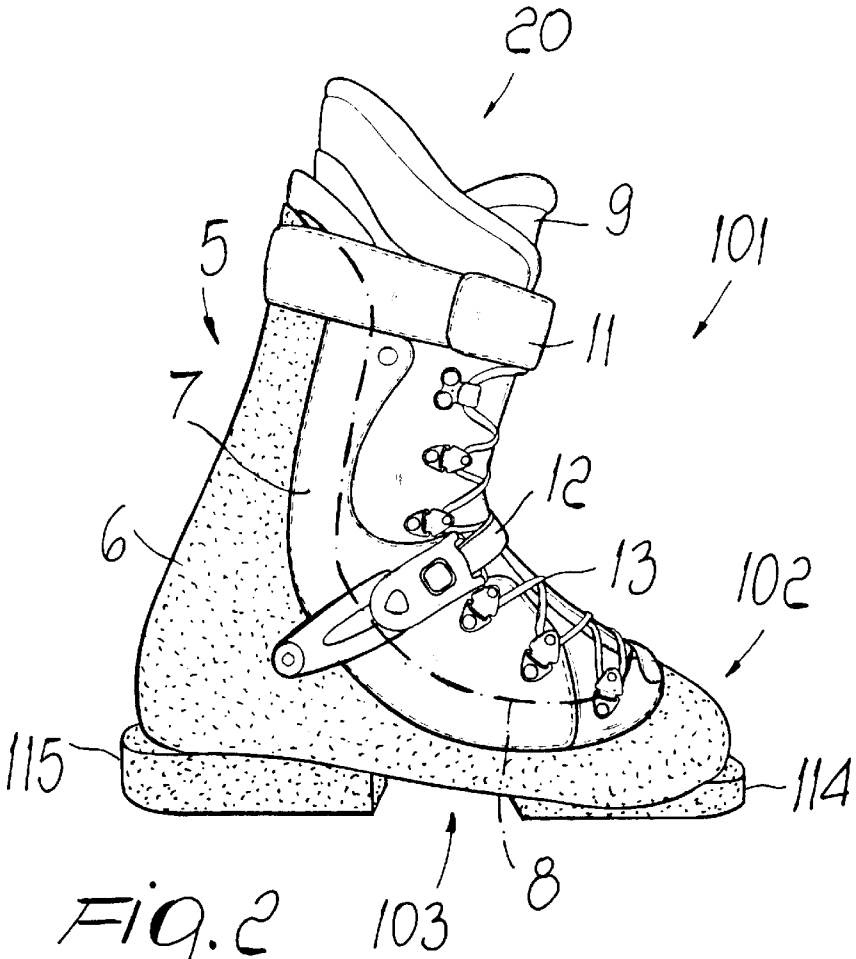

FIG. 2 illustrates a sports shoe 101 in which a standard toe unit 114 and a standard heel unit 115 are associated at the region 103 of the sole of the foot of the rigid supporting element 102, so as to obtain a ski boot.

Figure 3:
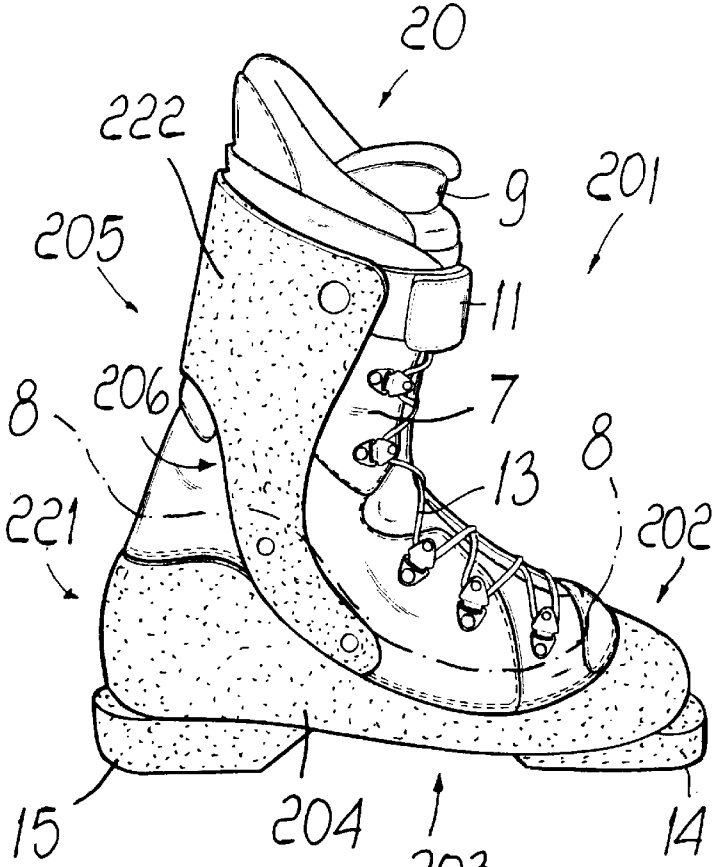
FIGS. 2, 3, 4, 5, 6, 7, 8 and 9 are side views of further embodiments of the sports shoe.

FIG. 3 illustrates a sports shoe 201 in which, differently from the previous embodiment, the rigid supporting element is constituted by a first component, designated by the reference numeral 202, which affects the region 203 of the sole of the foot, the region 204 of the sides of the foot, and the heel region 221. A second component 222 is rigidly associated at the region 204 of the sides of the foot, is also rigid and supporting, and affects the lateral regions 206 and partially the rear region 205 of the leg.

Figure 4:
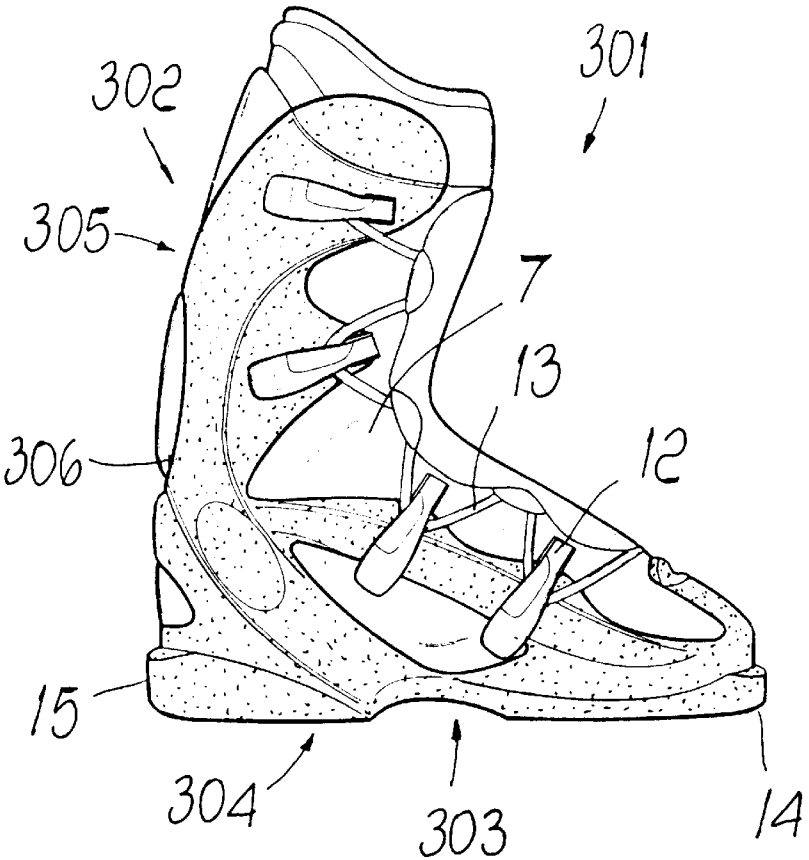

FIG. 4 illustrates a sports shoe 301 in which the rigid supporting element 302 affects a larger proportion of the sole region 303, of the region 304 of the sides of the foot, of the rear region 305 and of the region 306 of the sides of the leg.

Figure 5:
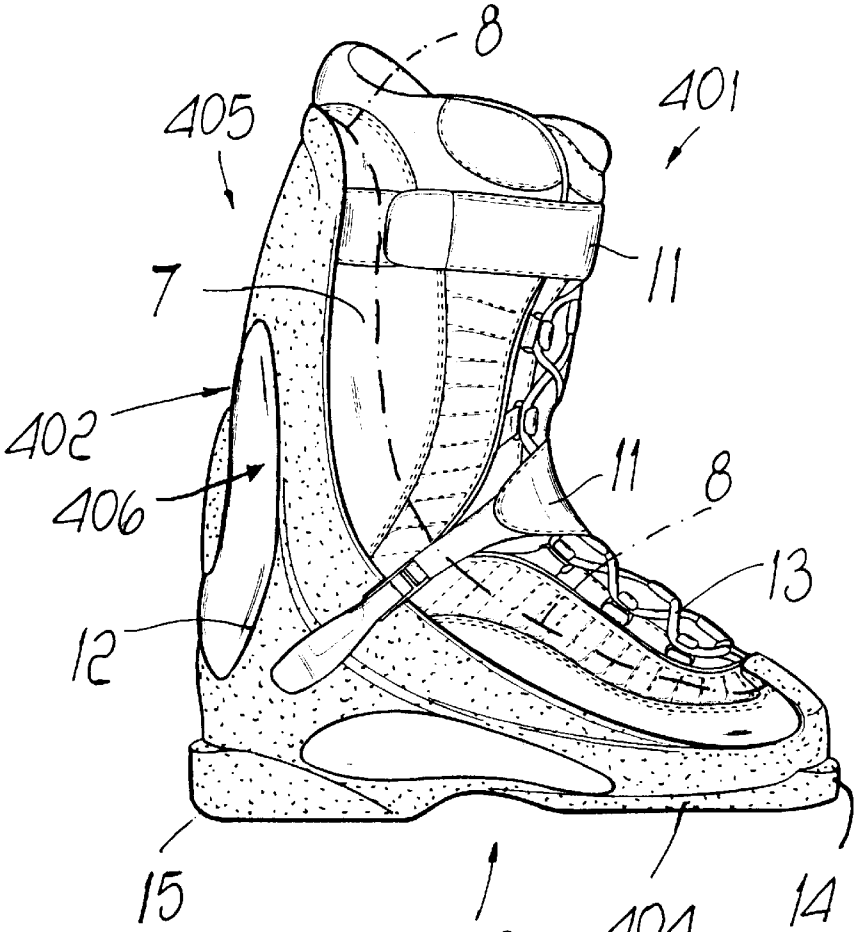

FIG. 5 illustrates a further embodiment of the sports shoe, 401, having a rigid supporting element 402 which affects to a greater or smaller extent one or more of said regions designated by the reference numeral 403, 404, 405 and 406.

Figure 6:
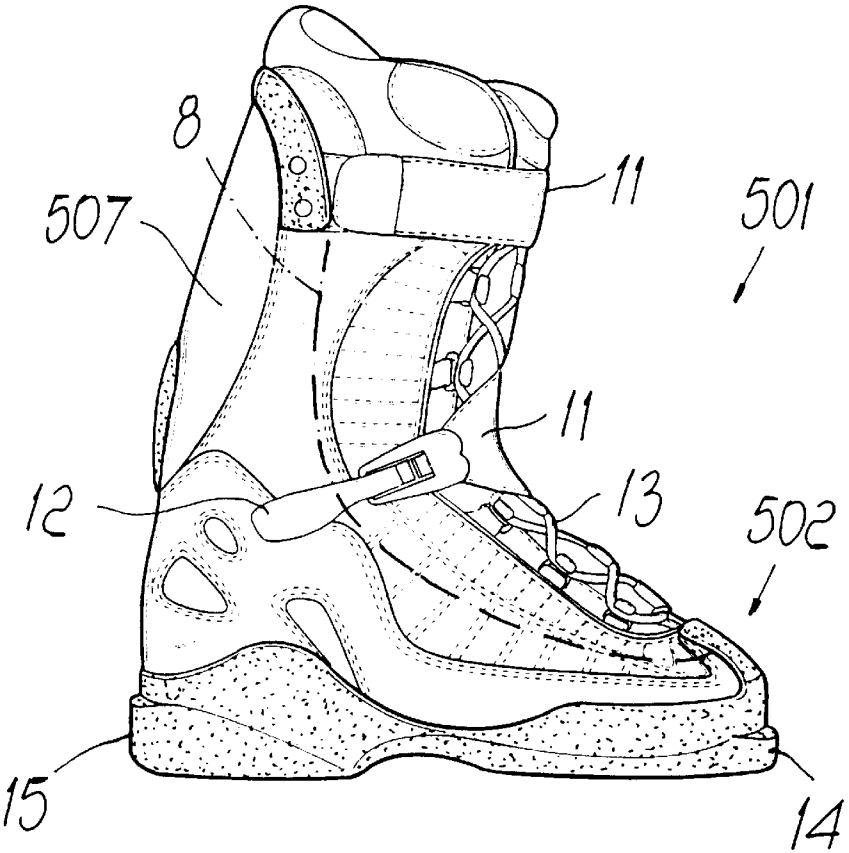

FIG. 6 illustrates a sports shoe 501, in which the soft upper 507 includes larger surfaces of the rigid supporting element 502.

Figure 7:
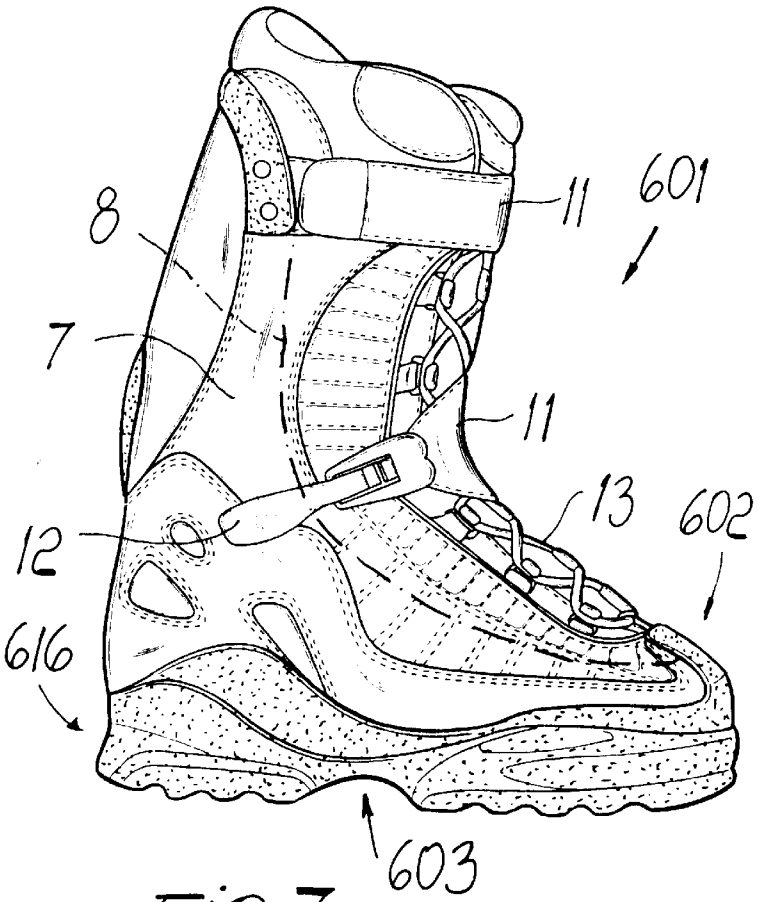

FIG. 7 illustrates a sports shoe 601, as in FIG. 6, wherein a snowboard or trekking sole 616 is associated at the sole region 603.

Figure 8:
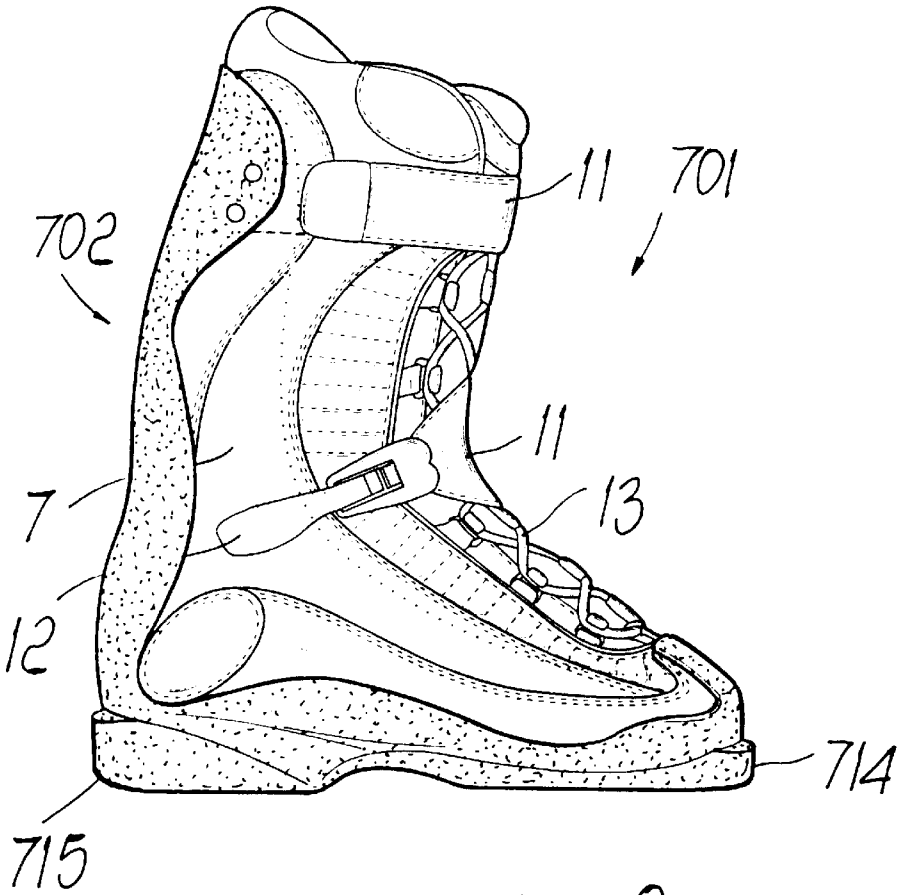

FIG. 8 illustrates a further sports shoe 701, in which the rigid supporting element 702 has yet another different configuration.

Figure 9:
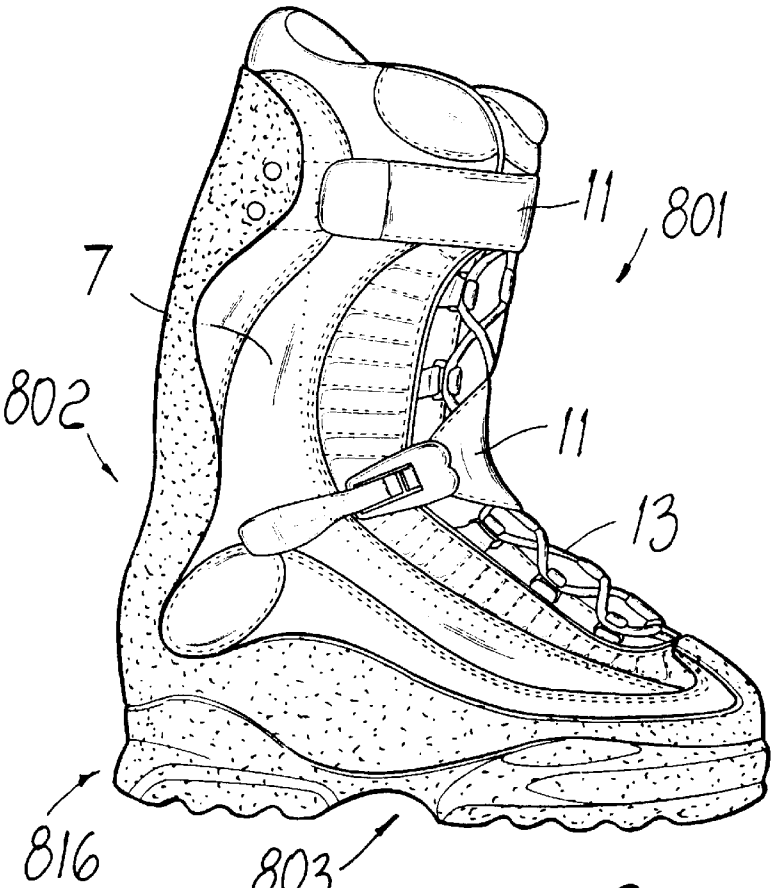

FIG. 9 is a view of a sports shoe 801, similar to that of FIG. 8, in which a snowboard or trekking sole 816 is associated at the region 803 of the sole of the foot instead of the standardized toe unit 714 and heel unit 715 of FIG. 8.

Figure 10:
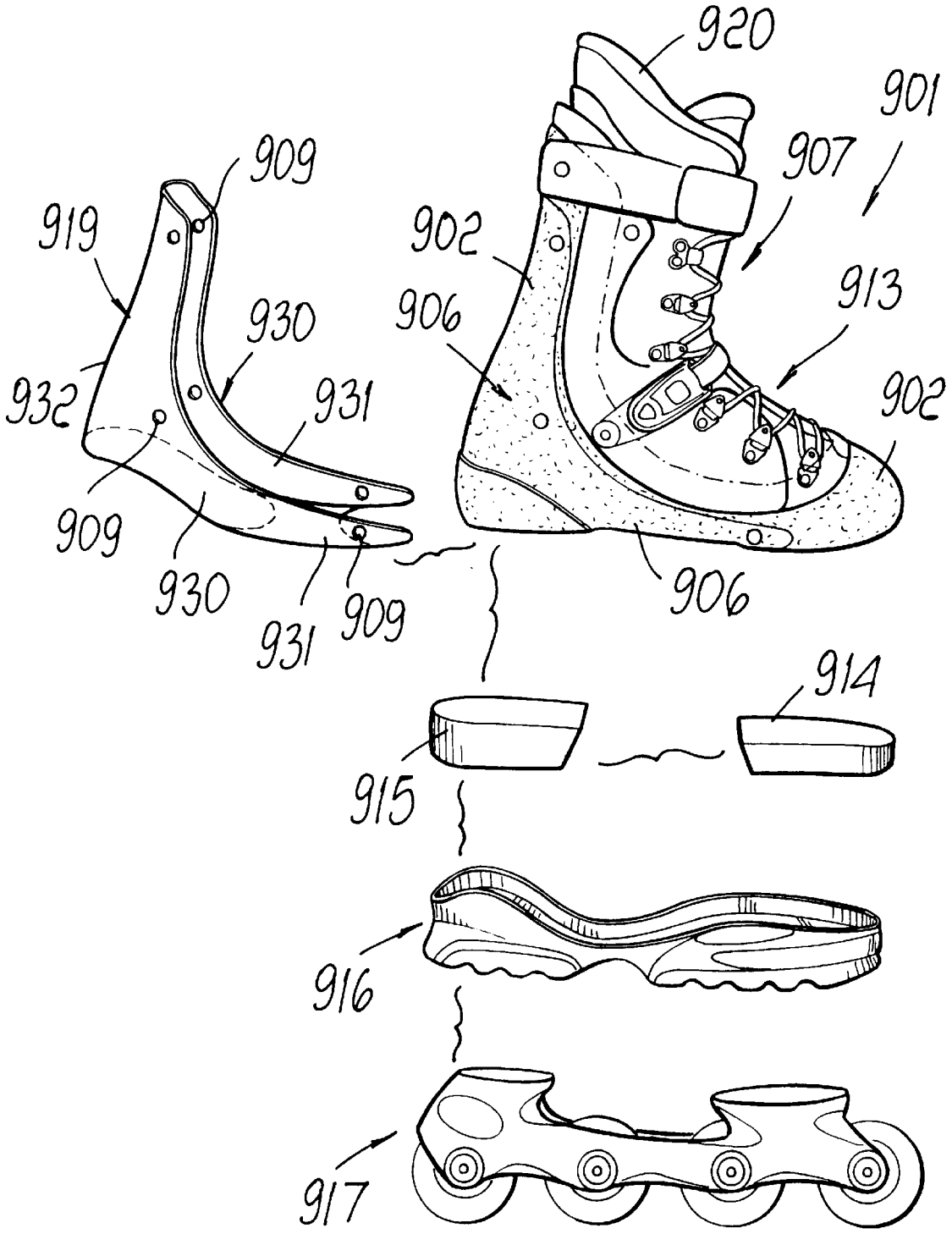
FIG. 10 is an exploded view of the shoe according to a further aspect of the invention.
Figure 11:
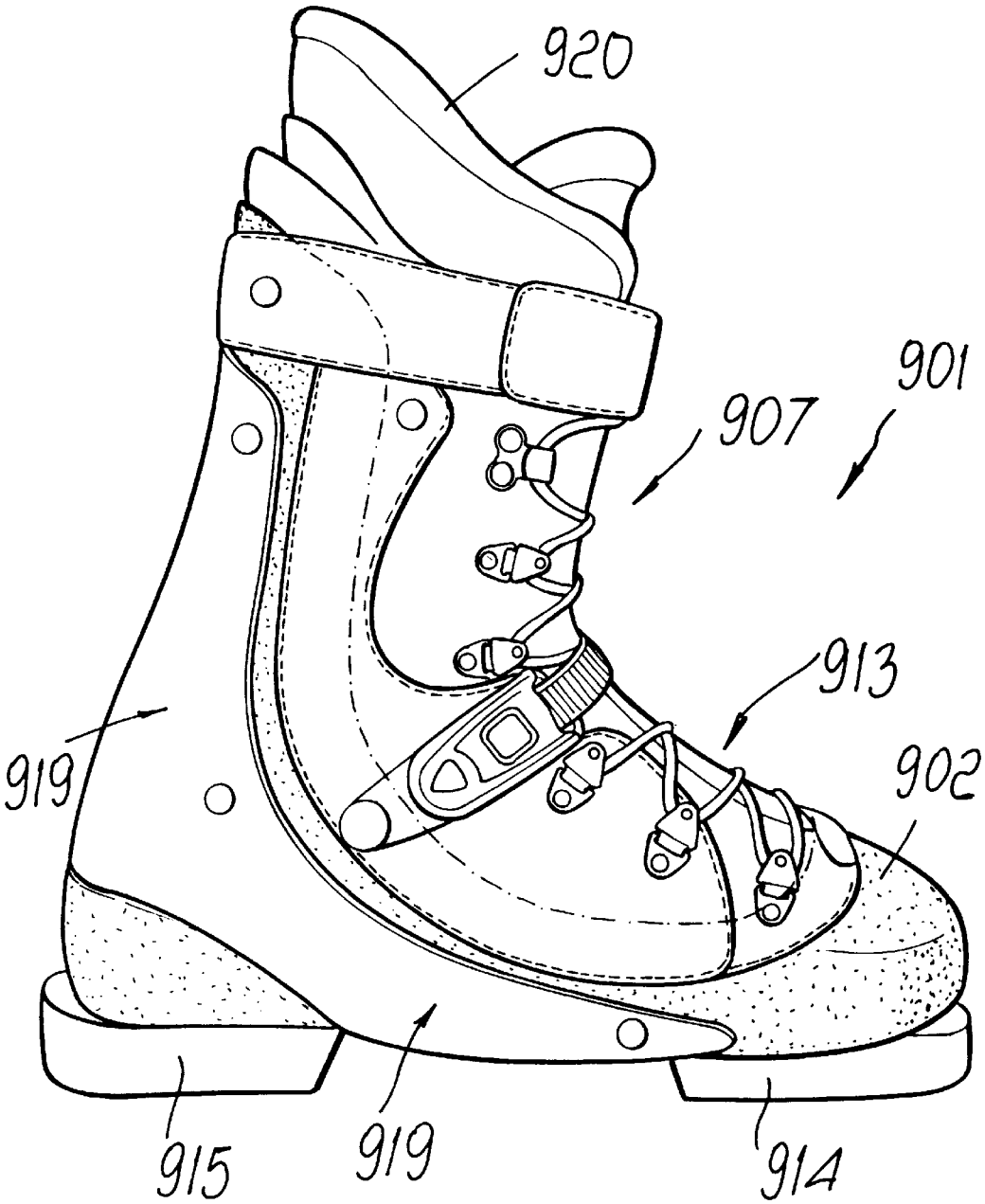
FIG. 11 is a side perspective view of the shoe of FIG. 10.

FIGS. 10 and 11 illustrate a sports shoe 901 according to still a further embodiment of the invention.

Shoe 901 comprises a main structure 902, constituting a rigid supporting element for a soft upper 907 containing an innershoe 920. The sports shoe also comprises closure members 913, such as for example laces, and a reinforcing member 919.

The main structure 902 is advantageously provided with a lowered portion 906 which surrounds the side, rear and lower portions of the shoe. The reinforcing member 919 is arranged at the lowered portion 906 and may be rigidly associated with the main structure for example by means of rivets provided at bores 909.

Reinforcing member 919 has side walls 930, terminal portions 931 and a back portion 932, respectively associated with the side, lower and rear portions of shoe 901.

Shoe 901 may be provided with several sole members according to the use. For example, the toe unit 914 and heel unit 915 are for use as a ski boot; sole 916 is adapted for use as a trekking shoe and the frame 917 is for use as an in-line skate.

Also, reinforcing member 919 may be made of different materials in order to provide different properties. For example, a more rigid shoe is required for skiing than for snowboarding or skating.

An advantage of the present invention is that the terminal portions 931 of the reinforcing member 919 reach the plantar arch region of the sole thereby further increasing the rigidity of the shoe.

The materials employed, as well as the configurations of the rigid supporting element 2, may of course be the most pertinent according to specific requirements.

What is claimed is:

1. A sports shoe, comprising a rigid supporting element and a soft upper, said rigid supporting element surrounding a sole region, side regions and a rear region of said shoe, said rigid supporting element being formed monolithically, and said soft upper partially and externally surrounding said rigid supporting element so as to include part of the region that is adjacent to the periphery of said rigid supporting element, the sports shoe further comprising closure means, said closure means comprising a first closure element which is connected to said rigid supporting element at an upper part of said rigid supporting element arranged at said rear region of said shoe, said first closure element extending from said upper part of said rigid supporting element and about said soft upper at a lower leg supporting region of said soft upper whereby for releasably closing said upper part of said rigid supporting element to said lower leg supporting region of said soft upper, and said closure means further comprising a second closure element which is connected to said rigid supporting element at a middle part of said rigid supporting element arranged between said rear region of said shoe and said sole region of said shoe, said second closure element extending from said middle part of said rigid supporting element and about said soft upper at a foot-instep supporting region of said soft upper whereby for releasably closing said middle part of said rigid supporting element to said foot-instep supporting region of said soft upper.

2. The sports shoe according to claim 1, comprising a reinforcing member.

3. The sports shoe according to claim 2, wherein said rigid supporting element comprises a lowered portion which surrounds said rear region, said side regions and said sole region, at least partially.

4. The sports shoe according to claim 3, wherein said reinforcing member is provided at said lowered portion.

5. The sports shoe according to claim 4, wherein said reinforcing member comprises a back portion provided with side walls having terminal portions.

6. The sports shoe according to claim 5, wherein said terminal portions are arranged at the plantar arch region of said sole region.

7. The sports shoe according to claim 1, wherein said rigid supporting element is substantially L-shaped in a side view.

8. The sports shoe according to claim 1, wherein said rigid supporting element extends so as to surround the region of the sole of the foot, the regions of the sides of the foot and of the metatarsus, and partially the rear region and the lateral regions of the user's leg.

9. The sports shoe according to claim 1, wherein a sole is associated below said at least one rigid supporting element, said sole being constituted by any one of:

a toe unit and a heel unit;

a sole for snowboarding;

a sole for trekking;

a frame having a plurality of wheels.

10. The sports shoe according to claim 1, comprising an inner padding associated with said rigid supporting element or with said soft upper.

11. The sports shoe according to claim 1, wherein said rigid supporting element is constituted by a first component which affects said sole region, said side regions and a region corresponding to the foot metatarsus, and a heel region, a second component being rigidly associated at said side regions and at said metatarsus region, said second component being rigid and affecting said side regions and at least partially said rear region.

12. The sports shoe of claim 1, wherein said first and second closure elements have ends which are connected to said rigid supporting element.

13. The sports shoe of claim 12, wherein said first and second closure elements comprise a strap and a lever.

14. A sports shoe, comprising a rigid supporting element and a soft upper, said rigid supporting element surrounding a sole region, side regions and a rear region of said shoe, said rigid supporting element being formed monolithically, and said soft upper partially and externally surrounding said rigid supporting element so as to include part of the region that is adjacent to the periphery of said rigid supporting element, the sports shoe further comprising a first closure element which is connected to said rigid supporting element at an upper part of said rigid supporting element arranged at said rear region of said shoe, said first closure element extending from said upper part of said rigid supporting element and about said soft upper at a lower leg supporting region of said soft upper whereby for releasably closing said upper part of said rigid supporting element to said lower leg supporting region of said soft upper, and the sports shoe further comprising a second closure element which is connected to said rigid supporting element at a middle part of said rigid supporting element arranged between said rear region of said shoe and said sole region of said shoe, said second closure element extending from said middle part of said rigid supporting element and about said soft upper at a foot-instep supporting region of said soft upper whereby for releasably closing said middle part of said rigid supporting element to said foot-instep supporting region of said soft upper.

15. The sports shoe of claim 14, wherein said first and second closure elements have ends which are connected to said rigid supporting element.

16. The sports shoe of claim 15, wherein said first and second closure elements comprise a strap and a lever.

* * * * *